US008356503B2

(12) United States Patent
Breuer et al.

(10) Patent No.: US 8,356,503 B2
(45) Date of Patent: Jan. 22, 2013

(54) ROLLING MILL FOR HOT-ROLLING METAL, ESPECIALLY ALUMINUM, AND HOT-ROLLING METHOD

(75) Inventors: Michael Breuer, Hilchenbach (DE); Paul Selbach, Wenden (DE); Hartmut Hof, Erndtebrück (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 817 days.

(21) Appl. No.: 10/575,601

(22) PCT Filed: Sep. 25, 2004

(86) PCT No.: PCT/EP2004/010794

§ 371 (c)(1),
(2), (4) Date: Apr. 12, 2006

(87) PCT Pub. No.: WO2005/049241

PCT Pub. Date: Jun. 2, 2005

(65) Prior Publication Data

US 2007/0051153 A1 Mar. 8, 2007

(30) Foreign Application Priority Data

Oct. 24, 2003 (DE) ..... 103 49 950

(51) Int. Cl.
*B21B 41/06* (2006.01)

(52) U.S. Cl. ..... 72/229

(58) Field of Classification Search ..... 72/225, 72/229, 234, 227, 200, 148; 29/527.7; 148/541
See application file for complete search history.

(56) References Cited

U.S. PATENT DOCUMENTS

| | | | | |
|---|---|---|---|---|
| 3,514,984 | A * | 6/1970 | Cook | 72/8.3 |
| 4,308,739 | A * | 1/1982 | Tippins | 72/229 |
| 4,348,882 | A * | 9/1982 | Tippins | 72/202 |
| 4,430,874 | A * | 2/1984 | Tippins et al. | 72/202 |

(Continued)

FOREIGN PATENT DOCUMENTS

| | | | |
|---|---|---|---|
| CN | 1154276 | | 7/1997 |
| JP | 53-131263 | | 11/1978 |
| JP | 05161902 | A * | 6/1993 |
| JP | 7-88528 | | 4/1995 |
| JP | 2000-271603 | | 10/2000 |

OTHER PUBLICATIONS

Machine Translation of JP 05-161902A Konose et al. (Jun. 29, 1993), pp. 1-7, translated on Feb. 11, 2010.*

*Primary Examiner* — Teresa M Ekiert
(74) *Attorney, Agent, or Firm* — Lucas & Mercanti, LLP; Klaus P. Stoffel

(57) ABSTRACT

The invention relates to a rolling mill (1) which is used to hot roll metal, in particular aluminium. Said rolling mill comprises a hot strip mill (3) provided with a pre-rolling train (4) and a finishing rolling train (5). The aim of the invention is to improve said rolling mill such that it is more compact and/or such that the systems, which are already compact, are more productive. The pre-rolling train (4) is embodied as a tandem train, wherein the rolling product is milled in a tandem mode for jointly involving at least two pre-rolling frames (8, 9) arranged one behind the other. Alternatively or simultaneously, the pre-rolling train (4) and the finishing train (5) work together as a tandem train. Milling occurs place in the tandem mode when the frame of the pre-rolling train and the finishing train are used together. In the finishing train, milling can take place, preferably, in a reversing tandem mode.

7 Claims, 2 Drawing Sheets

U.S. PATENT DOCUMENTS 4,433,566 A * 2/1984 Tippins et al. ..... 72/229
4,503,697 A * 3/1985 Tippins et al. ..... 72/202
4,522,050 A * 6/1985 Thomas ..... 72/229
5,219,114 A * 6/1993 Kajiwara et al. ..... 228/158
5,343,726 A * 9/1994 Reth ..... 72/225
5,802,902 A * 9/1998 Rosenthal et al. ..... 72/201
6,182,490 B1 * 2/2001 Ginzburg et al. ..... 72/229
6,286,354 B1 * 9/2001 Kajiwara et al. ..... 72/237
2003/0051525 A1 * 3/2003 Kramer ..... 72/229

* cited by examiner

ROLLING MILL FOR HOT-ROLLING METAL, ESPECIALLY ALUMINUM, AND HOT-ROLLING METHOD

The invention concerns a rolling mill for hot rolling metal, especially aluminum, with a hot-strip mill comprising a roughing train and a finish-rolling train. The invention also concerns a corresponding hot-rolling method.

The rolling of aluminum in hot-strip mills is well known. The conventional layout 100 for a hot-rolling mill of this type, an example of which is shown in FIG. 3, comprises the principal processing stations of the furnace region 102, the rolling train 103, and possibly the finishing station (dressing and straightening).

An aluminum billet 117 is brought to rolling temperature in furnaces 120, 121, for example, hearth-type furnaces or pusher-type furnaces, passed through an edging stand 107, and then roughed in the single-stand roughing stand 108 of the roughing train 104. During the roughing, the roughed product is subjected to a first cropping with a first shear 122. Before entering the finish-rolling train 105, which consists, as shown here as an example, of four stands 111, 112, 123, 124, the mill bar 119 is cropped at the beginning and end of the mill bar by the cropping shears 122, 125, which are separated by a specific distance. The strip 113 finish rolled in the finish-rolling train 105 runs along trimming shears 126 and is coiled by a coiler 114 driven by driving rolls 127.

An installation of this type with a furnace region 102 and rolling trains 103 can have an enormous overall length. For example, the length x of a furnace region 102 may be 130 m, and the distance between the roughing stand 108 and the first stand 111 of the finish-rolling train may be 240 m, and these distances affect the coil sizes that can be produced. In this regard, the rolling stock passes through the rolling mill installation with the aid of extensive conveying and guiding devices, such as roller tables. Rolling mills of this type tend to operate more economically with larger coil dimensions.

Installations with overall lengths of this size require large capital investment and a large amount of building area. Furthermore, the lengthy roller tables for conveying the rolling stock likewise require large capital investment.

Proceeding from this prior art, the objective of the invention is to create a rolling mill with a more compact type of construction for hot rolling metal, especially aluminum, wherein the conveyance intervals between the individual processing stations (furnace region, roughing, finish rolling) are reduced. At the same time, a hot-rolling method is to be created that allows the rolling of strip to the final rolled thickness with a compact construction of the rolling mill and a high degree of economy.

The basic idea of the invention is that a compact design of the rolling mill or the hot-strip mill arises from the systematic utilization of tandem rolling in the roughing train, in the finishing train, or in the roughing train and the finishing train. The roughing train alone and/or the finishing train alone or the roughing and finishing train together are tandem trains, i.e., sections of the installation in which the rolling stands are arranged one after the other (tandem arrangement). Due to the resulting compact construction, considerable parts of the otherwise necessary roller tables can be eliminated, which results in reduced capital expenditures.

In accordance with the invention, it is proposed that the roughing train be designed as a tandem train, which can comprise two roughing stands arranged one after the other. This roughing train preferably operates as a reversing train.

The roughing train can also be a single-stand roughing train. It then operates in tandem operation with the finishing train. The distance between the roughing train and the finish-rolling train is selected in such a way that all of the stands can roll simultaneously.

In addition, it is proposed that the finish-rolling train have two coilers, and that the finish-rolling train be operated in tandem operation.

The proposed layout is not intended only for new constructions but rather is also suitable for modernization of existing installations. In particular, the tandem rolling in the roughing train and/or finishing train makes it possible for smaller installations, in which only relatively small tonnages and relatively small coils have been produced up until now, whose further processing is uneconomical in some cases, to be retrofitted in such a way that the coil weights (strip lengths) can be increased while the length of the roller tables remains the same, so that productivity is increased.

In a preferred layout, two roughing stands are provided in the roughing train, and two finishing stands are provided in the finish-rolling train, with each train operating in tandem operation. All together, with this layout with four stands, one rolling stand can be saved compared to the conventional layout with five stands. Moreover, the two roughing stands in the new layout can be realized as cost-saving two-high stands, while the finishing stands are four-high stands.

Additional details and advantages of the invention are specified in the dependent claims and in the following description, in which the specific embodiments of the invention illustrated in the drawings are explained in greater detail.

Figure 3:
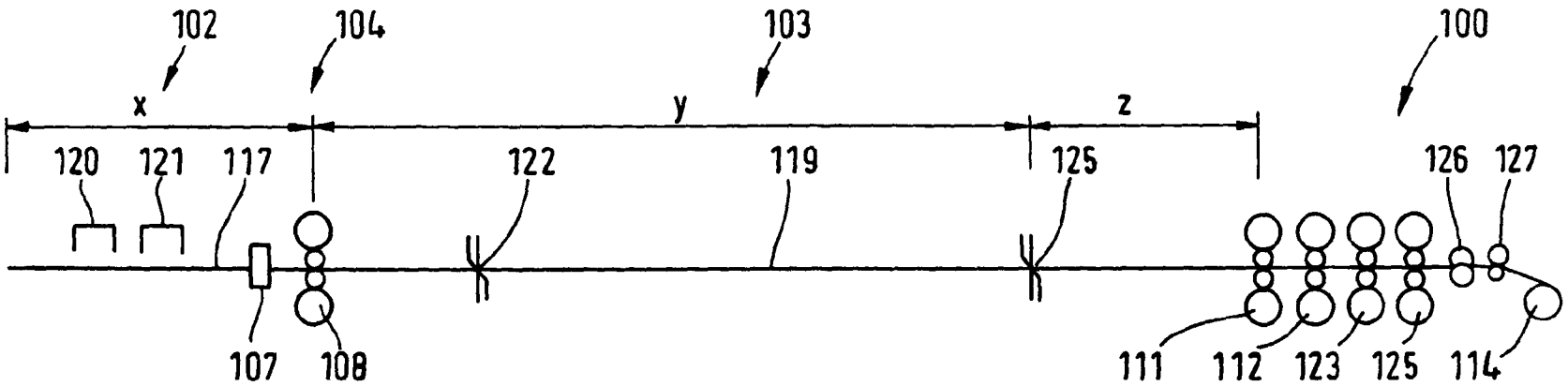
FIG. 3 Prior Art
FIG. 3 shows the installation layout of a conventional hot-strip mill for aluminum for purposes of comparison.
Figure 1:
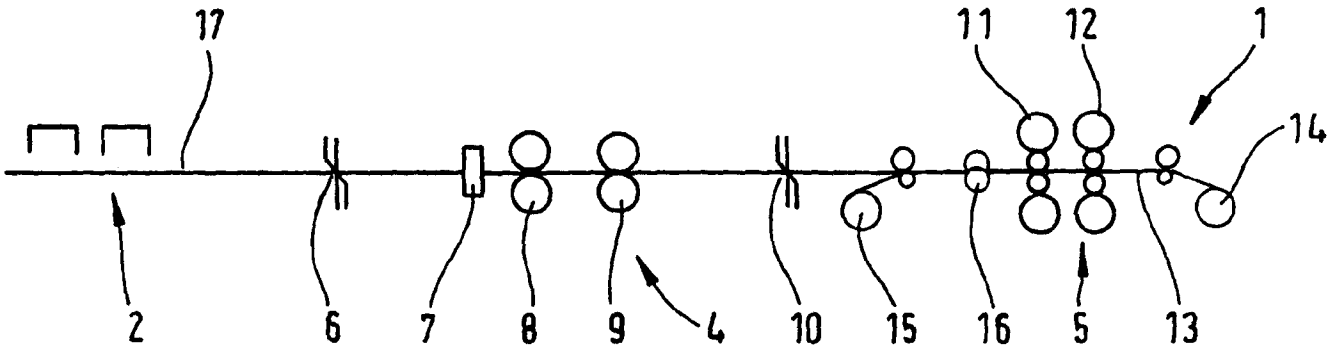
FIG. 1 shows the compact installation layout of the rolling mill for rolling aluminum in accordance with the invention.

FIG. 1 shows the new compact hot-rolling mill layout 1 for aluminum. Comparison with the prior-art layout 100 in FIG. 3 illustrates the compactness of the installation of the invention. The installation of the invention also comprises a furnace region 2 and the rolling train 3 with a roughing train 4 and a finish-rolling train 5.

A heavy cropping shear 6 and an edging stand 7 are arranged downstream of the furnace region 2. In the illustrated embodiment, the roughing stand 4 comprises two roughing stands 8, 9 arranged one after the other, which operate in reversing tandem operation. The roughing stand 4 is followed by a flying shear 10 for preparing the rolling stock for finish rolling. The finish rolling is carried out in the finish-rolling train 5, which comprises two closely arranged four-high stands 11, 12, such that the strip 13 can be rolled in a reversing operation. For this purpose, a first coiler 15 is located upstream of the finish-rolling train 5, and a second coiler 14 is located downstream of the finish-rolling train 5. A trimming shear 16 is located downstream of the first coiler 15.

Compared to the previously known installation, the overall length of the installation of the invention in FIG. 1 is significantly shorter, especially where the distance between the end of the roughing train 4 and the first stand 11 of the finish-rolling train 5 is concerned. The proposed installation is very compact, and at the same time, it is possible to produce high coil weights. Compared to the conventional installation (FIG. 3), only a flying shear 10 is additionally installed between the roughing train 4 and the finish-rolling train 5.

Figure 2:
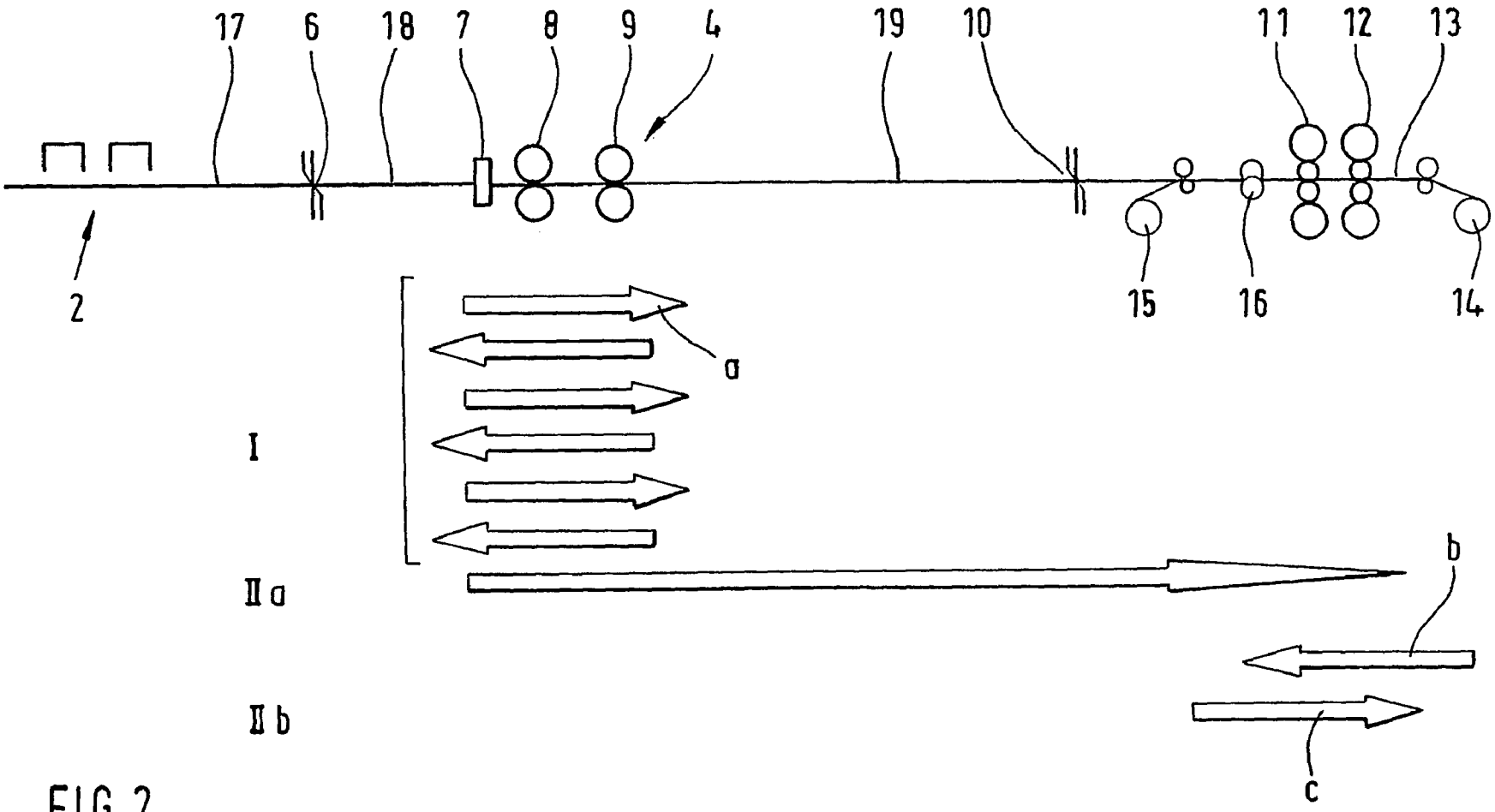
FIG. 2 shows the manner in which the rolling method of the invention is carried out in a rolling mill of the invention.

The method itself is illustrated in FIG. 2. To carry out the hot-rolling operation, a hot aluminum billet 17 is placed on a roller table 18 and carried into the tandem roughing train 4, where it is rolled out in a tandem reversing operation in the two roughing stands 8, 9, for example, three times back and forth, as indicated by the arrows a and designated as rolling step I. The tail end of the strip is subjected to a first cropping by the heavy cropping shear 6. After a sufficient number of reversing operations have been carried out, the mill bar 19 that is obtained can now be conveyed directly into the finish-rolling stand 5 with the simultaneous participation of all of the stands. Accordingly, a tandem operation takes place in all of the stands of the roughing train and the finish-rolling train. The mill bar 19 is finish rolled into strip 13 by tandem rolling in stands 11, 12 of the finish-rolling train 5 (rolling step II).

In accordance with another variant of the method (IIb), the roughed product is rolled out in the finishing stands 11, 12 by tandem reversing rolling between the two coilers 14, 15. After the first rolling operation with simultaneous participation of the two finishing stands 11, 12, the strip 13 is coiled with the second coiler 14. The tail end of the strip is cropped with a flying shear 10. The direction of rotation of the upper and lower rolls of the stands 11, 12 is then reversed (arrow b), and the strip 13 is drawn back into the finishing stands 11, 12. The strip 13 is coiled by the first coiler 15 and simultaneously uncoiled from the second coiler 14, and then the direction is reversed again (arrow c). The reversing operation can be repeated according to the desired final thickness of the strip 13.

The use of tandem rolling in a hot-strip mill for aluminum makes it possible to achieve a significant increase in the productivity and economy of compact plants that previously operated uneconomically.

LIST OF REFERENCE NUMBERS

1 hot-rolling mill layout
2 furnace region
3 rolling train or hot-strip mill
4 roughing train
5 finish-rolling train
6 heavy cropping shear
7 edging stand
8 roughing stand, two-high stand
9 roughing stand, two-high stand
10 flying shear
11 finish-rolling stand, four-high stand
12 finish-rolling stand, four-high stand
13 strip
14 second coiler
15 first coiler
16 trimming shear
17 billet, initial product
18 roller table
19 mill bar, roughed product
100 conventional hot-rolling mill layout
102 furnace region
103 rolling train
104 roughing train
105 finish-rolling train
107 edging stand
108 roughing stand
111-112 stands
113 strip
114 coiler
117 aluminum billet
119 mill bar
120 furnace
121 furnace
122 cropping shear
123 stand
124 stand
125 light cropping shear
126 trimming shears
127 driving rolls
x, y, z distances
a, b, c arrows
I roughing in tandem operation
II roughing in tandem operation with all stands
IIa reversing finish rolling in tandem operation between two coilers

The invention claimed is:

1. Rolling mill (1) for hot rolling aluminum, with a hot-strip mill (3) comprising a roughing train (4) and a finish-rolling train (5), wherein the roughing train (4) is designed as a tandem train, in which the rolling stock is rolled in tandem operation with the simultaneous participation of at least two roughing stands (8, 9) installed one after the other; wherein the finish-rolling train (5) comprises as a tandem train at least two finishing stands (11, 12) installed one after other, with which the rolling stock is rolled in tandem operation with the simultaneous participation of each finishing stand (11, 12); and wherein coilers (15, 14) are installed upstream and downstream, respectively, of the finish-rolling train (5), wherein the roughing train (4) operates together with the finishing train (5) as a tandem train, wherein the rolling stock is rolled in tandem operation with the simultaneous participation of the stands of the roughing train and the finishing train, the roughing train not including a coiler so that the rolling stock passes directly from the roughing train to the finishing train, wherein the roughing tandem train (4) and the finishing train (5) are operated in a reversing mode.

2. Rolling mill in accordance with claim 1, wherein the roughing tandem train (4) comprises two-high stands (8, 9).

3. Rolling mill in accordance with claim 1 with the following layout:

furnace region (2) for supplying heat to an initial product before shaping,
heavy cropping shear (6),
edging stand (7),
two roughing stands (8,9) installed one after the other, which operate in tandem operation in a reversing mode,
a flying shear (10),
a first coiler (15),
two finishing stands (11, 12) installed one after the other, which operate in tandem operation in a reversing mode, and
a second coiler (14).

4. Method for hot rolling aluminum, wherein the initial product is roughed and then finish rolled in a hot-strip mill (3) with a roughing train (4) and a finish-rolling train (5); wherein the initial product is roughed in the roughing train (4) itself, which is equipped as a tandem train with at least two roughing stands (8, 9) installed one after the other, in tandem operation with simultaneous participation of each roughing stand; and wherein the roughed rolling stock (19) in the finishing train (5), which is equipped as a tandem train with at least two finishing stands (11, 12) installed one after the other, in a rolling mill (1) in accordance with claim 1, wherein the rolling stock is rolled in the roughing train (4) together with the finishing train (5) in tandem operation, the roughing tandem train (4) and the finishing train (5) being operated in a reversing mode, all of the stands of the at least one roughing stand and the at least one finishing stand working simultaneously when operating as a tandem.

5. Method in accordance with claim 4, comprising rolling out the initial product in the roughing stands (8, 9) and running the rolled product into the finishing train (5) with simultaneous participation of all stands of the roughing train (4) and the finishing train (5) (step IIa).

6. Method in accordance with claim 4, comprising rolling out the initial product in the roughing stands (8, 9) and subsequent reversing finish rolling in tandem operation of the finishing train (5).

7. Method in accordance with claim 6, comprising the following steps:

conveyance of a hot aluminum billet as the initial product (17) into a tandem roughing train (4), reversing roughing with the roughing stands (8, 9) in tandem operation (step I), initial cropping of the roughed product (19), especially the aluminum mill bar, by means of a heavy shear (6), rolling out to a predetermined roughing thickness of the roughed product (19), cropping of the roughed product (19) with a flying shear (10), coiling of the strip (13) that has been run through the finishing train (5), which operates in tandem operation, with a second coiler (14), which is installed downstream of the finishing train (5), reversal of the direction of movement of the rolling stands (11, 12) and drawing the strip (13) back into the finishing train (5), coiling onto a coiler (15) upstream of the finishing train (5) with simultaneous uncoiling from the second coiler (14), and carrying out the rolling step in the finishing train (5) one or more times (step IIb).

* * * * *

UNITED STATES PATENT AND TRADEMARK OFFICE

CERTIFICATE OF CORRECTION

PATENT NO. : 8,356,503 B2
APPLICATION NO. : 10/575601
DATED : January 22, 2013
INVENTOR(S) : Breuer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 593 days.

Signed and Sealed this
First Day of September, 2015

Michelle K. Lee

Michelle K. Lee
*Director of the United States Patent and Trademark Office*